US009975096B2

(12) United States Patent
Banus

(10) Patent No.: US 9,975,096 B2
(45) Date of Patent: May 22, 2018

(54) VIBRATION-ASSISTED APPARATUS FOR MIXING IMMISCIBLE LIQUIDS AND FOR MIXING POWDERS WITH LIQUIDS OR WITH OTHER POWDERS

(71) Applicant: Christopher T. Banus, Nashua, NH (US)

(72) Inventor: Christopher T. Banus, Nashua, NH (US)

( * ) Notice: Subject to any disclaimer, the term of this patent is extended or adjusted under 35 U.S.C. 154(b) by 399 days.

(21) Appl. No.: 14/422,727

(22) PCT Filed: Aug. 15, 2013

(86) PCT No.: PCT/US2013/055059
§ 371 (c)(1),
(2) Date: Feb. 20, 2015

(87) PCT Pub. No.: WO2014/031425
PCT Pub. Date: Feb. 27, 2014

(65) Prior Publication Data

US 2015/0224460 A1 Aug. 13, 2015

Related U.S. Application Data

(60) Provisional application No. 61/684,870, filed on Aug. 20, 2012, provisional application No. 61/710,021, filed on Oct. 5, 2012.

(51) Int. Cl.
*B01F 11/02* (2006.01)
*B01F 7/00* (2006.01)
(Continued)

(52) U.S. Cl.
CPC ..... *B01F 11/0225* (2013.01); *B01F 3/0819* (2013.01); *B01F 3/1242* (2013.01);
(Continued)

(58) Field of Classification Search
CPC .. B01F 11/0225; B01F 3/0819; B01F 3/1242; B01F 5/065; B01F 7/0015;
(Continued)

(56) References Cited

U.S. PATENT DOCUMENTS 3,575,383 A * 4/1971 Coleman ..... B08B 3/12 134/184
3,751,012 A 8/1973 Michenko et al.
(Continued)

FOREIGN PATENT DOCUMENTS

CN 201855671 U 6/2011
CN 203139960 U 8/2013
(Continued)

OTHER PUBLICATIONS

EP Search Report dated Mar. 7, 2016 of Patent Application EP13831379 Filed Feb. 24, 2015.
(Continued)

*Primary Examiner* — Anshu Bhatia
(74) *Attorney, Agent, or Firm* — Maine Cernota & Rardin

(57) ABSTRACT

A batch or continuous mixer for mixing powders, immiscible liquids, or a powder with a liquid includes one or more vibrational energy applicators which propagate vibrational energy into the mixture, causing powders to flow like liquids and breaking up liquid droplets and powder clumps. In embodiments, the vibration frequency and amplitude are selected according to properties of the mixture components. Vibrations can be propagated through container walls, impellers, or other structures within the mixing container. Vibrated structures can be flexibly supported for enhanced propagation of the vibrations. Vibrational energy can be uniform throughout the container, or focused in a desired region. Ultrasonic energy can be simultaneously applied with acoustic energy.

18 Claims, 14 Drawing Sheets

(51) Int. Cl.

| | |
|---|---|
| ***B01F 7/08*** | (2006.01) |
| ***B01F 7/16*** | (2006.01) |
| ***B01F 7/18*** | (2006.01) |
| ***B01F 7/30*** | (2006.01) |
| ***B01F 7/32*** | (2006.01) |
| ***B01F 9/00*** | (2006.01) |
| ***B01F 9/02*** | (2006.01) |
| ***B01F 15/00*** | (2006.01) |
| ***B01F 5/06*** | (2006.01) |
| ***B01F 7/04*** | (2006.01) |
| ***B01F 3/08*** | (2006.01) |
| ***B01F 3/12*** | (2006.01) |

(52) U.S. Cl.
CPC ..... *B01F 5/065* (2013.01); *B01F 7/0015* (2013.01); *B01F 7/0045* (2013.01); *B01F 7/00208* (2013.01); *B01F 7/047* (2013.01); *B01F 7/08* (2013.01); *B01F 7/161* (2013.01); *B01F 7/165* (2013.01); *B01F 7/1665* (2013.01); *B01F 7/18* (2013.01); *B01F 7/30* (2013.01); *B01F 7/32* (2013.01); *B01F 9/005* (2013.01); *B01F 9/02* (2013.01); *B01F 11/02* (2013.01); *B01F 11/0241* (2013.01); *B01F 11/0258* (2013.01); *B01F 11/0266* (2013.01); *B01F 15/00746* (2013.01)

(58) Field of Classification Search
CPC .... B01F 7/00208; B01F 7/0045; B01F 7/047; B01F 7/08; B01F 7/161; B01F 7/165; B01F 7/1665; B01F 7/18; B01F 7/30; B01F 7/32; B01F 9/005; B01F 9/02; B01F 11/02; B01F 11/0241; B01F 11/0258; B01F 11/0266; B01F 15/00746
USPC ..... 366/115, 116
See application file for complete search history.

(56) References Cited

U.S. PATENT DOCUMENTS

| | | | | |
|---|---|---|---|---|
| 4,259,021 | A * | 3/1981 | Goudy, Jr. | B01F 5/0609 123/25 B |
| 4,380,399 | A * | 4/1983 | Godat | B01F 7/1695 366/289 |
| 4,859,070 | A * | 8/1989 | Musschoot | B06B 1/10 366/116 |
| 6,015,225 | A | 1/2000 | Williams | |
| 2005/0265120 | A1* | 12/2005 | Naoe | B01F 3/1221 366/114 |
| 2009/0052273 | A1* | 2/2009 | Sarvazyan | B01F 11/0266 366/116 |
| 2009/0162447 | A1* | 6/2009 | Kaully | A61K 9/0017 424/490 |
| 2011/0019496 | A1* | 1/2011 | Hsieh | B01F 3/0819 366/111 |

FOREIGN PATENT DOCUMENTS

| | | | |
|---|---|---|---|
| CN | 203253399 | U | 10/2013 |
| CN | 103611457 | A | 3/2014 |
| EP | 454106 | A1 | 10/1991 |
| JP | 2003112918 | A | 4/2003 |
| JP | 2003220321 | A | 8/2003 |
| KR | 20120068383 | A | 6/2012 |
| WO | 2004002614 | A1 | 1/2004 |
| WO | 2008129591 | A | 10/2008 |

OTHER PUBLICATIONS

PCT Search Report dated Nov. 21, 2013 of Patent Application No. PCT/US213/055059 Filed Aug. 15, 2013.

* cited by examiner

VIBRATION-ASSISTED APPARATUS FOR MIXING IMMISCIBLE LIQUIDS AND FOR MIXING POWDERS WITH LIQUIDS OR WITH OTHER POWDERS

RELATED APPLICATIONS

This application claims the benefit of U.S. Provisional Application No. 61/684,870, filed Aug. 20, 2012 and No. 61/710,021, filed Oct. 5, 2012, both of which are herein incorporated by reference in their entirety for all purposes.

FIELD OF THE INVENTION

The invention relates to mixing apparatus, and more particularly to apparatus for mixing immiscible liquids and/or mixing powders with liquids or with other powders.

BACKGROUND OF THE INVENTION

Mixing of immiscible liquids and/or mixing a particulate solid, herein referred to generically as a "powder," with a liquid or with another powder are important requirements in many applications and industries. Examples of mixing two immiscible liquids are found throughout the chemical, petroleum, mining, and pharmaceutical industries. These include dispersing and emulsifying food components when preparing mayonnaise, or mixing latex with water to make water based paints.

Powders are mixed with liquids during the manufacture of paints, inks, fillers, caulks, composite plastics, toothpastes, greases modified with metal powder, concrete, and some foodstuffs such as when dry ingredients are mixed with batter.

Examples of manufacturing processes which require mixing of two or more dry powders include mixing dry pigment blends, mixing sand with cement before adding water to make concrete, mixing granulated sugar with flour or with powdered sugar or cocoa powder in the manufacture of food products, and mixing of pharmaceuticals.

Mixing of liquids with liquids, liquids with powders, and powders with powders is especially critical when the volume of one of the liquids or powders is very small relative to the volume(s) of the other or others, for example when adding a catalyst or a small percentage additive to a resin system.

Many different types of mixing apparatus are commonly used for mixing immiscible liquids, mixing powders with liquids, and/or mixing powders with other powders. Most mixers fall into one of two basic categories: a "continuous" mixer or a "batch" mixer. In a continuous mixer, the components are continuously added in appropriate ratios to an "input" of the mixer. The components are mixed as they flow through the mixer, and then are dispensed from an "output" of the mixer. This process is continued until the desired quantities of components have been mixed.

In a batch mixer, the full quantities of all of the components to be mixed are placed into the interior of a container at the beginning of the mixing process, and the components remain in the container until the mixing is complete, after which the entire contents of the container are removed. FIG. 1A illustrates a batch mixer which includes a large capacity mixing container 100 typically capable of mixing a load weighing between 100 kg and 10,000 kg. The batch mixer of FIG. 1A is an example of a "vertical shaft" mixer which blends the contents of the mixing container 100 by using a rotating "high speed disperser blade" or "impeller" (106 in FIG. 1B) suspended on a vertical shaft 102 within the interior of the mixing container 100 and driven by a motor 104. FIG. 1B illustrates the motor, shaft, and disperser blade of a similar model of vertical shaft batch mixer.

FIG. 1C illustrates a typical flow pattern for the contents of a vertical shaft batch mixer of the type illustrated in FIG. 1A. The impeller 106 is typically designed to propel the contents of the container 100 in both horizontal and vertical directions, thereby creating convection flow within the container which tends to mix all portions of the contents together. In this example, the impeller 106 is a "high sheer" blade, which is designed to create high sheer stresses within a viscous mixture, thereby helping to break up large droplets and/or any clumps of powder granules.

FIG. 2 illustrates a typical medium speed vertical shaft batch mixer used, for example, to mix mortar or paste. This design includes two impellers 106 driven by two parallel shafts 102. Mixer sizes for this general style can range from small laboratory models to large production models, with container capacities between about 2 kg and 10,000 kg.

FIG. 3 illustrates another style of vertical shaft batch mixer, which operates at a low or medium speed, and is typically used for mixing viscous materials such as mortar, bread or pastry dough, or paste. Other examples of such viscous materials include mixing carbon black and/or other powders into latex or synthetic rubber bases to create useful "rubber" materials for tires, hoses, plastics, etc. Since these "liquids" are often too viscous to create convection flow, this style of mixer, referred to herein as a "planetary" mixer, includes a complex "planetary" impeller 106 having a plurality of distributed mixing elements which sweep through most of the container volume as the vertical shaft 102 rotates. Sizes for this type of mixer can typically range from small kitchen models up to industrial models with a 10,000 kg or 15,000 kg capacity. FIG. 4 illustrates the design of a typical planetary impeller 106 which might be used in a mixer such as FIG. 3.

The vertical shaft batch mixers illustrated in FIGS. 1A through 4 are typically used for mixing immiscible liquids and/or mixing a powder with a liquid (note that herein the term "liquid" is used to refer to both low viscosity liquids such as water and high viscosity liquids such as dough, certain resins, and polymer bases). Such mixing can include multi-step mixing, for example using a Hockmeyer or Kohler type, high RPM, high sheer dispersing mixer having a serrated blade disperser for first dissolving liquid additives into a base liquid, and then dispersing dry solid materials (e.g. pigment, fillers, or reactants) into the liquid.

In general, vertical shaft batch mixers are not satisfactory for mixing two dry powders together, since dry powders lack the fluid viscosity necessary for establishing the convective flow illustrated in FIG. 1C, or even the local flow required for a vertical shaft planetary mixer. Hence, when it is necessary to mix two powders in a batch mixer, a "horizontal" batch mixer is frequently used. In a horizontal batch mixer, either an agitator or the container itself is tumbled or rotated about a horizontal axis, so as to lift the contained powders or other contents and cause them to be impelled by gravity to mix with each other.

An example of a horizontal shaft batch mixer is illustrated in FIG. 5, wherein the mixing container 100 is shaped roughly as a "V," and is rotated about a horizontal axis. In some models of horizontal batch mixer, the interior walls of the container 100 include baffles or fins which further help to lift and mix the contents as the container is rotated. Sizes for this type of mixer can range typically from small laboratory models up to industrial models having a container capacity of about 20,000 kg or more.

Another type of "closed vessel" horizontal mixer is illustrated in FIG. 6, and an "open-vessel" horizontal mixer is illustrated in FIG. 7. For these two mixer designs, the container is stationary, and the contents are mixed by a horizontally rotating agitator 106. Due to the horizontal geometry, the agitator 106 is able to vertically lift portions of the container contents as the agitator rotates, after which the lifted contents mix as they fall back toward the bottom of the container 100.

Many styles of horizontal batch mixer are able to mix powders with almost any other material, including a second powder, a viscous "liquid" such as bread dough, or a non-viscous liquid such as water. Horizontal mixers can be useful for multi-step mixing processes such as mixing concrete, where first two powders (cement and gravel) must be mixed, and then the combined powders must be mixed with water.

The primary difficulty which must be overcome by a mixer in mixing immiscible liquids is to minimize the sizes of the droplets within the resulting emulsion. Initially, the mixer will tend to separate the two liquids into interspersed regions, and larger regions will continue to be separated into smaller regions until the mixture becomes an emulsion of suspended liquid droplets. However, depending on properties of the liquids such as their viscosities and surface tensions, once the droplets have been reduced to a certain size, further droplet size reduction becomes difficult as droplets of each liquid collide and coalesce with each other into larger droplets as they move through the mixture.

In general, for a mixer to mix a powder with a liquid or with another powder, the mixer must overcome at least three difficulties. First, the granules of a powder do not naturally flow in the manner of a liquid. Second, in a manner which resembles the droplets formed by immiscible liquids, the granules of a powder tend to aggregate together and form "clumps," such that the clumps may tend to remain intact even when they are dispersed throughout the liquid or second powder in the proper weight percentage. Third, the granules of a powder can tend to adhere to the walls of a container and to the surfaces of an agitator, so that some fraction of the powder remains unmixed.

The failure of powders to flow like liquids generally excludes the use of vertical shaft batch mixers when mixing two dry powders together, as discussed above. Instead, other mixer styles such as horizontal batch mixers are typically used. When mixing a powder with a liquid in a continuous mixer, it is sometimes necessary to add more of the liquid phase than would be desirable, simply to reduce the viscosity and allow the mixture to flow through the mixing tube.

When immiscible liquid droplets and/or particle clumping are a concern, a batch mixer is generally used, since it is difficult for a continuous mixer to address the problem of droplet size and particle clumping. When mixing immiscible liquids or mixing a powder into a viscous liquid, the problems of droplets and/or powder clumping are sometimes addressed in a vertical shaft batch mixer by using a "high sheer" impeller (see FIG. 1C), which is designed to generate high sheer forces within the mixture in an attempt to break up droplets and/or powder clumps. However, this can lead to heating of the mixture, with a consequent loss of viscosity and/or damage to the mixture, so that active cooling of the mixing container 100 is sometimes needed to prevent damage to the mixture and to maintain sufficient viscosity for the sheer forces to be effective in breaking up the droplets and/or clumps. An example where loss of viscosity is of concern is in resinous liquids, which can experience rapid declines in viscosity as their temperature increases.

Generally speaking, for each application and each industry in which mixing of immiscible liquids or mixing of a powder with a liquid or with another powder is required, an appropriate style of mixer and a time and energy requirement for proper mixing are known. For many of these industries, the energy consumed and the mixing time required are important contributors to the total cost of a production process. Quality and degree of mixing are also highly important. Apparatus and methods for reducing the required time and energy while improving the quality and degree of mixing would therefore be highly desirable.

What is needed, therefore, is an apparatus and method for reducing the time and energy required for mixing immiscible liquids and/or mixing a powder with a liquid or with another powder.

SUMMARY OF THE INVENTION

A batch or continuous mixer for mixing immiscible liquids and/or mixing a powder with a liquid or with another powder includes one or more vibrational energy applicators which propagate vibrational energy into the contents of the mixing container, thereby vibrating droplets and breaking them into smaller droplets, and/or vibrating powder granules and causing them to flow like a liquid. The vibrational energy further causes the powder granules to vibrate against each other, thereby breaking up clumps, and to vibrate away from container walls, baffles, and agitator surfaces. In embodiments where a powder is one of the mixed components, the frequency and amplitude of the vibration are selected according to the average particle masses and sizes and the particle density of the powder or powders, as well as the viscosity of the liquid (if any). In some embodiments, vibrations having more than one frequency and/or more than one amplitude are applied.

In various embodiments, the one or more vibrational energy applicators are cooperative with external surfaces of walls of the mixing container. In some embodiments, the vibrational energy applicators are configured so as to propagate vibration waves through the interior of the mixing container with an approximately uniform intensity. In other embodiments, a plurality of vibrational energy applicators is configured so as to focus vibration waves near interior surfaces, such as agitator or baffle surfaces.

In some embodiments, the vibrational energy applicators are cooperative with regions of the container walls which include thin metal panels and/or elastomeric materials, so as to better propagate the vibrational energy through the container walls and into the mixing region. For example, in some embodiments the vibrational energy is applied to a section of the container wall which is elastomeric and functions essentially as a "drum" through which acoustic or ultrasonic energy can pass. In other embodiments the vibrational energy is applied to a metal panel which is attached to the remainder of the container wall by an elastomeric spacer or gasket, so that the metal panel can easily vibrate without the energy being absorbed by the surrounding metal wall.

In various embodiments, the vibrational energy applicators impart vibrational energy directly to an impeller, to a baffle, or to some other structure located within the mixing tube or chamber, so that the agitated structure itself vibrates and thereby imparts vibrational energy to the contents of the mixing container or mixing tube.

It is useful in the context of the present invention to note that there are fundamentally four types of mixing forces which can be applied to the contents of a mixer. Mixing forces of the first type are referred to herein as "convective"

mixing forces, which are forces that tend to move the droplets or powder particles throughout a substantial portion of the volume of the mixer. Mixing forces of the second type are referred to herein as "sheer" mixing forces, which are forces that are applied to a droplet or a clump of particles in a non-uniform manner, whereby different regions of the droplet or particle clump feel forces having different amplitudes and/or directions. All of the prior art mixer designs described in the Background section apply some type of convective mixing forces, and some of them also apply sheer mixing forces.

Mixing forces of the third type are referred to herein as "acoustic" mixing forces, which are vibrational forces that tend to move the droplets or powder particles macroscopically and translationally over distances comparable with the dimensions of the droplets or particles. Mixing forces of the fourth type are referred to herein as "ultrasonic" mixing forces, which are vibrational forces that tend to vibrate the individual droplets or powder particles without moving them translationally. Unless otherwise specified, the term "vibrational" mixing forces is used herein to refer generically to both acoustic and ultrasonic mixing forces.

In various embodiments, the frequencies, amplitudes, phases, distribution, and/or other characteristics of the vibrations are selected so as to provide maximum agitation of the droplets and/or powder particles and clumps. For example, in some embodiments vibrational energy is applied with a frequency of less than 5 kHz, and an acoustic wave amplitude of between 1 micron and 5 mm. In other embodiments, ultrasonic energy is applied having a frequency of between 1 kHz and 500 MHz.

In certain embodiments, the characteristics of the vibrational energy are selected according to the properties of the materials being mixed. For example, when using a vertical shaft batch mixer to mix a first powder having a d-50 of 10 microns with a second powder having a d-50 of 50 microns, in some embodiments vibrational energy is applied to the mixing container walls at a frequency of between 10 Hz and 4000 Hz, and with an amplitude of between 10 microns and 200 microns. This causes the two powders to flow as if they were liquids, and enables them to be effectively and quickly mixed using a disperser type mixer/blade impeller. In addition, the vibration causes the powder particles to impact each other, independently of the impeller, in such a way as to break up clumps of powder particles and reduce the time and energy required for mixing the powders. Note that without the present invention, a vertical shaft batch mixer that was otherwise of the same design would be largely ineffective in mixing the two powders.

In various embodiments, the present invention eliminates the need for sheer forces to break up droplets or particle clumps, and thereby eliminates the need for the mixture to be viscous. Hence, in some of these embodiments, cooling of the mixture to maintain viscosity is not required. In fact, in certain embodiments the mixture is heated, either before it enters the mixer and/or while it is in the mixer, so as to further reduce its viscosity. In embodiments, viscosity reductions due to heating (or lack of cooling), for example in resinous liquids, allow the mixture to be mixed more quickly and with less energy. In other embodiments less liquid is required, since the vibrational energy and/or heating of the mixture reduces the viscosity of the mixture and allows it to be mixed at a higher concentration.

Embodiments of the present invention can be pressurized so as to prevent boiling and/or escape of volatile liquid components such as polyester resins, even if the mixture is heated.

One general aspect of the present invention is a mixing apparatus for mixing a first substance with a second substance. The mixing apparatus includes a mixing container which is able to contain a mixable combination of the first substance and the second substance, a convection mechanism for applying convective mixing forces to the mixable combination, and at least one vibrational energy applicator, the vibrational energy applicator being able to apply vibrational energy to the mixable combination while the convective mixing forces are applied to the mixable combination.

In various embodiments, the vibrational energy is at least one of acoustic and ultrasonic energy.

In embodiments, the mixing apparatus is a batch mixer. In some of these embodiments, the mixing apparatus is a vertical shaft batch mixer. In other of these embodiments the mixing apparatus is a horizontal batch mixer.

In embodiments, the mixing apparatus is a continuous mixer. In some of these embodiments, the continuous mixer includes a mixing tube having a wall with a non-uniform thickness profile. Other of these embodiments further include a rotatable mixing shaft contained within a mixing tube of the continuous mixer. And some of these embodiments further include a plurality of mixing shafts contained within the mixing tube of the continuous mixer.

In certain embodiments the vibrational energy is applied to the mixable combination by propagation of the vibrational energy through at least one portion of at least one wall of the mixing container. In some of these embodiments at least one of the wall portions of the mixing container through which vibrational energy is propagated includes a wall section which is thinner than surrounding portions of the container wall. In other of these embodiments at least one of the wall portions of the mixing container through which vibrational energy is propagated includes an elastomeric material.

In various embodiments the vibrational energy is applied to a mixing feature which extends into an interior of the mixing container. In some of these embodiments the mixing feature is a mixing impeller. In other of these embodiments the mixing feature is a fin or baffle attached to a wall of the mixing container. And in some of these embodiments the fin or baffle is attached to the wall by a flexible attachment which allows movement of the fin or baffle relative to the wall.

In some embodiments the apparatus includes a plurality of vibrational energy applicators, the vibrational energy applicators being configured to apply vibrational energy at a substantially uniform intensity throughout the mixable combination.

In other embodiments the apparatus includes a plurality of vibrational energy applicators, the vibrational energy applicators being configured to concentrate vibrational energy in a desired region within the mixing container.

Certain embodiments further include a heating apparatus which is able to heat the mixable combination while the convective mixing forces and vibrational energy are applied to the mixable combination. In various embodiments the mixing container is configured so that it can be pressurized while the convective mixing force and the vibrational energy are applied to the mixable combination.

And some embodiments further include an ultrasonic generator which is able to apply ultrasonic energy to the mixable combination while the convective mixing force and acoustic vibrational energy are applied to the mixable combination.

Another general aspect of the present invention is a method for mixing a first substance with a second substance. The method includes placing the first substance and the second substance in a mixing container as a mixable combination, applying a convective mixing force to the mixable combination, and applying vibrational energy to the mixable combination while the convective mixing force is applied to the mixable combination.

In embodiments at least one of a frequency and an amplitude of the vibrational energy is selected according to at least one property of at least one of the substances. In some embodiments the vibrational energy includes a plurality of at least one of frequencies and amplitudes. In other embodiments the vibrational energy is applied with a frequency of less than 5 kHz, and a vibrational wave amplitude of between 1 micron and 5 mm.

In various embodiments the first substance is a first powder which has a d-50 of 10 microns and the second substance is a second powder having a d-50 of 50 microns, and the vibrational energy is applied at a frequency of between 10 Hz and 4000 Hz, and with an amplitude of between 10 microns and 200 microns.

Certain embodiments further include applying heat to the mixable combination while applying the convective mixing force and the vibrational energy to the mixable combination.

Some embodiments further include pressurizing the mixing container while applying the convective mixing force and the vibrational energy to the mixable combination. And other embodiments further include applying ultrasonic energy to the mixable combination while applying the convective mixing force and the vibrational energy to the mixable combination.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a mixer for mixing immiscible liquids, or for mixing a powder with a liquid or with another powder. The mixer includes one or more vibrational energy applicators that propagate vibrational energy into the mixing container or tube, thereby vibrating droplets and causing them to break into smaller droplets, and/or thereby vibrating powder granules and causing them to flow like a liquid, vibrate against each other and break up clumps, and vibrate away from container walls and baffle and agitator surfaces.

Figure 9:
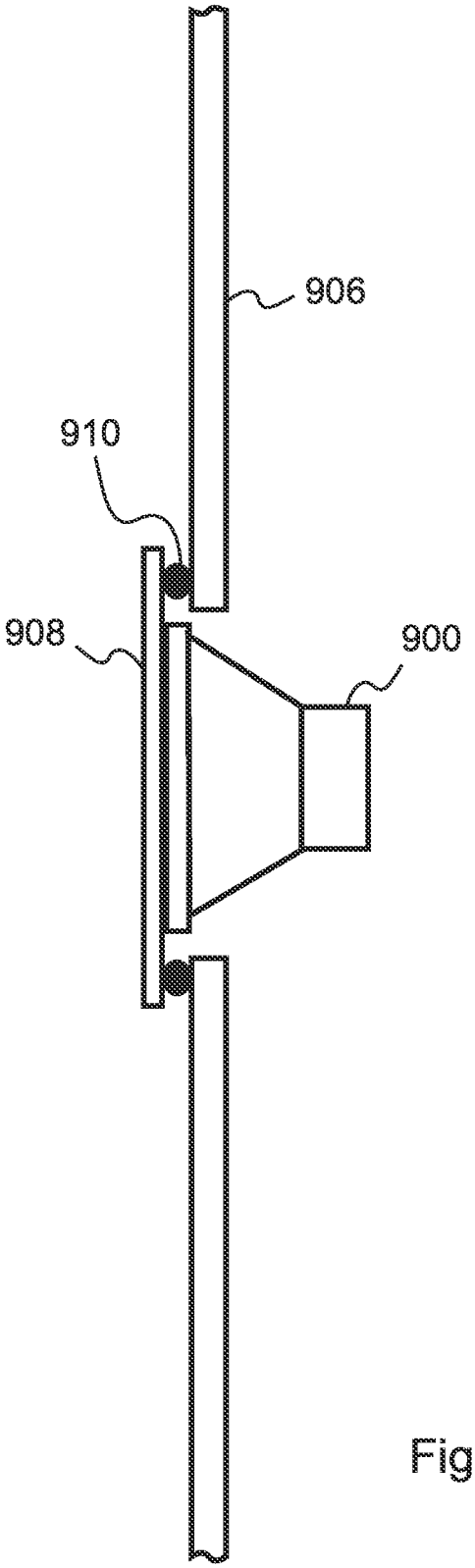
FIG. 9 is a cross sectional view of a region of a container wall showing an embodiment of the present invention applied to a thin plate sealed to a hole in the container wall by an elastomeric gasket which reduces loss of vibrational energy to the container.

FIG. 9 illustrates an embodiment in which a plurality of vibrational energy applicators 900, 902, 904 are cooperative with the container walls 906 of a vertical shaft batch mixer similar to the mixers of FIGS. 1A through 4. Some of the vibrational energy applicators 900, 904 are located along the sides of the container 100, while others 902 are located along the bottom of the container 100. Some of the vibrational energy applicators 900, 902 are arranged on the sides and bottom of the container 100 and synchronized so as to generate an approximately uniform field of vibrational energy throughout the mixing container 100. In similar embodiments, four mechanical vibrating motors are attached around the circumference of the bottom of a large, round, flat-bottom mixing container 100 such as the mixing chamber 100 of FIG. 9, so as to produce a single harmonized wave of motion and vibration for the entire contents of the mixing container 100.

Other vibrational energy applicators 904 in FIG. 9 are located and synchronized so as to focus vibrational energy in one or more desired regions of the mixing container 100, such as the region immediately surrounding the impeller 106. In similar embodiments, vibrational energy applicators 904 are arranged and synchronized to create within the mixing container 100 a volume containing a particular vibrational energy and/or wave type that enhances the mixing action for the particular materials being processed.

Figure 8:
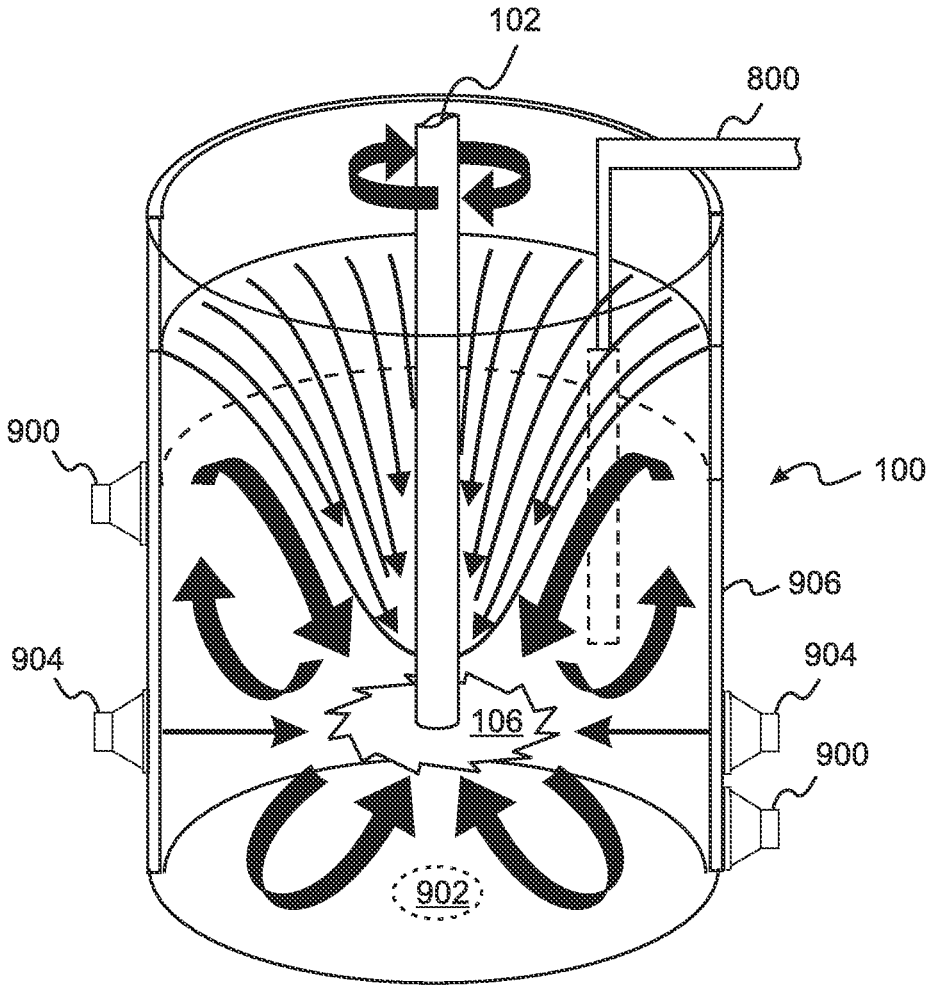
FIG. 8 is a perspective view similar to FIG. 1C showing an embodiment of the present invention applied to walls and to the base of the mixing container; also showing an acoustic horn positioned directly in the mixed material

In the embodiment of FIG. 8, the vibrational energy is mainly acoustic energy, which passes through specific locations on the mixing container walls 906 and is propagated into the mixing container 100 as vibrational waves. The vibrational energy applicators 900, 902, 904 in FIG. 8 do not attempt to vibrate or shake the entire mixing container 100 as a whole. Also, FIG. 8 shows an acoustic horn 800 which is positioned in the mixed material for better proximity to the mixing blades and for maximum acoustic energy transfer to the mixed material.

Note that FIG. 8 is intended mainly to illustrate functionality. For example, a preferred shape in practice for the mixing container 100 of FIG. 8 would include sides that meet the bottom over a radius, rather than at a sharp 90 degree angle.

With reference to FIG. 9, in various embodiments the vibrational energy applicators 900 are cooperative with regions of the container walls 906 which include thin metal plates 908 and/or elastomeric materials 910 that enable vibrational energy from the vibrational energy applicators 900 to penetrate more easily into the interior of the mixing container 100. In the embodiment of FIG. 9, a thin plate 908 is sealed over an opening in the container wall 906 using an elastomeric gasket 910 which prevents the mixture from leaking out of the container 100, while reducing the amount of vibrational energy which is transferred from the plate 908 to the wall 906.

Figure 1A:
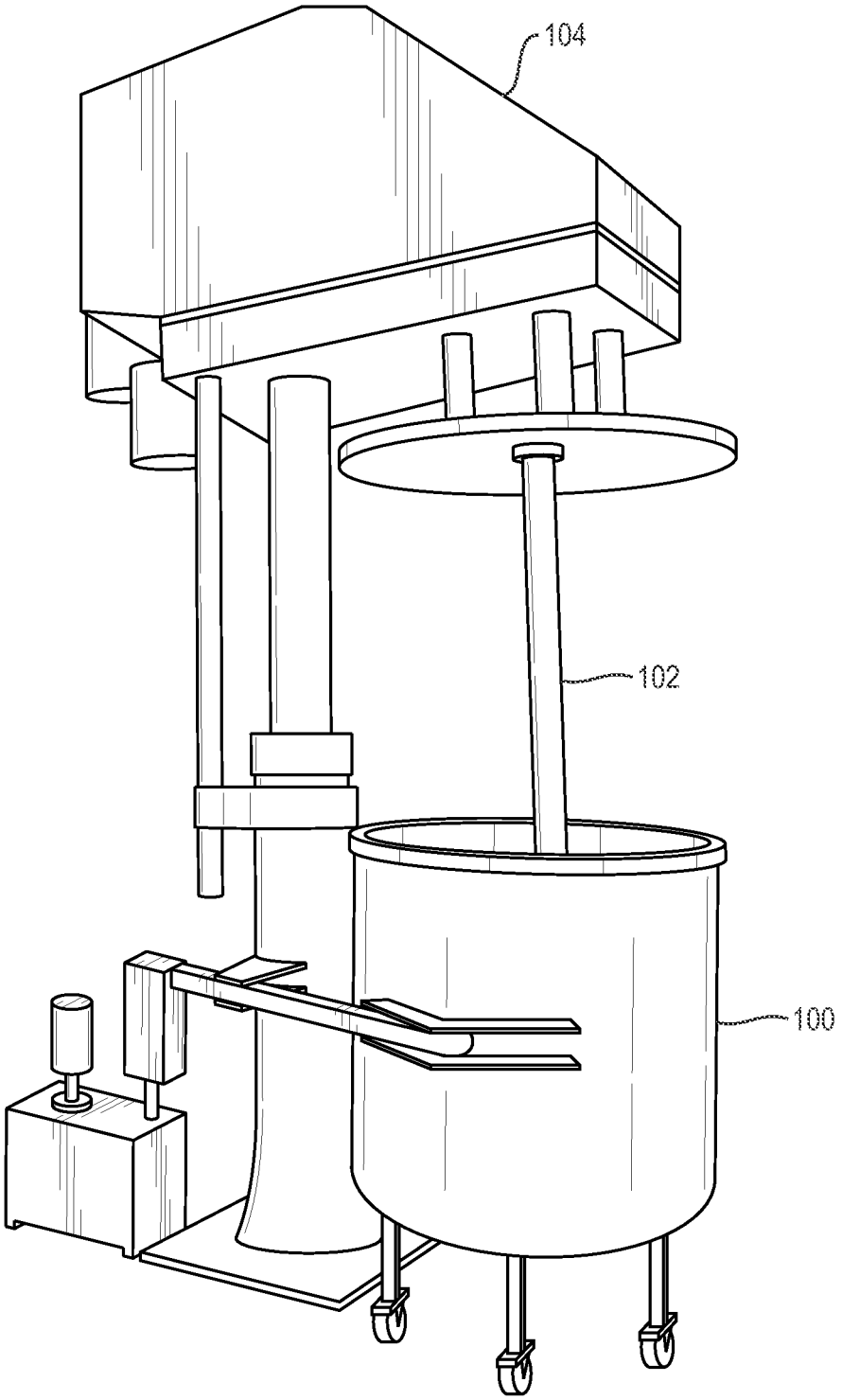
Figure 1A Prior Art
FIG. 1A is a perspective view of a large vertical shaft batch mixer of the prior art.
Figure 1B:
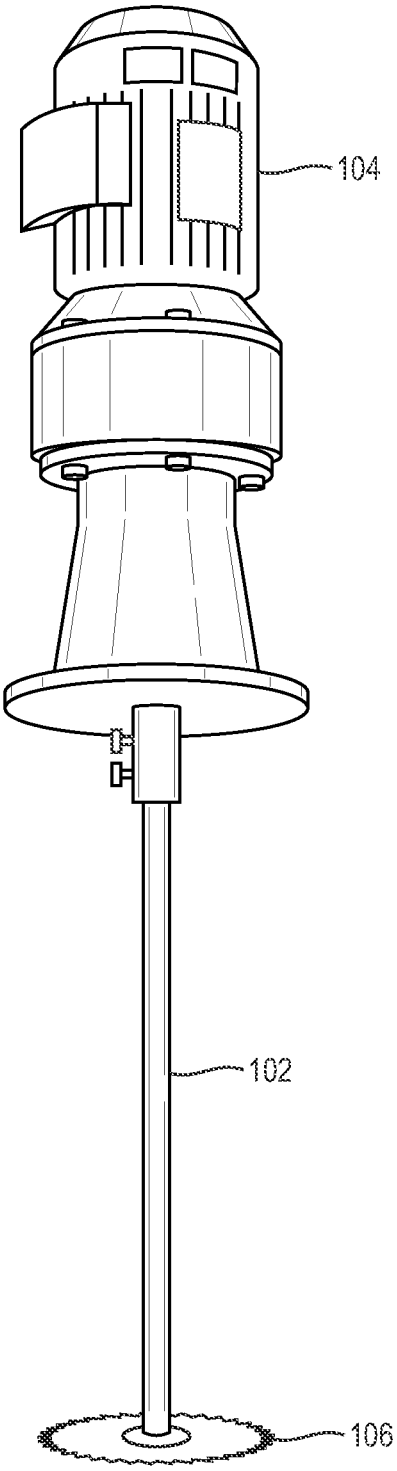
Figure 1B Prior Art
FIG. 1B is a perspective view of a motor, shaft, and impeller of a vertical shaft batch mixer of the prior art.
Figure 1C:
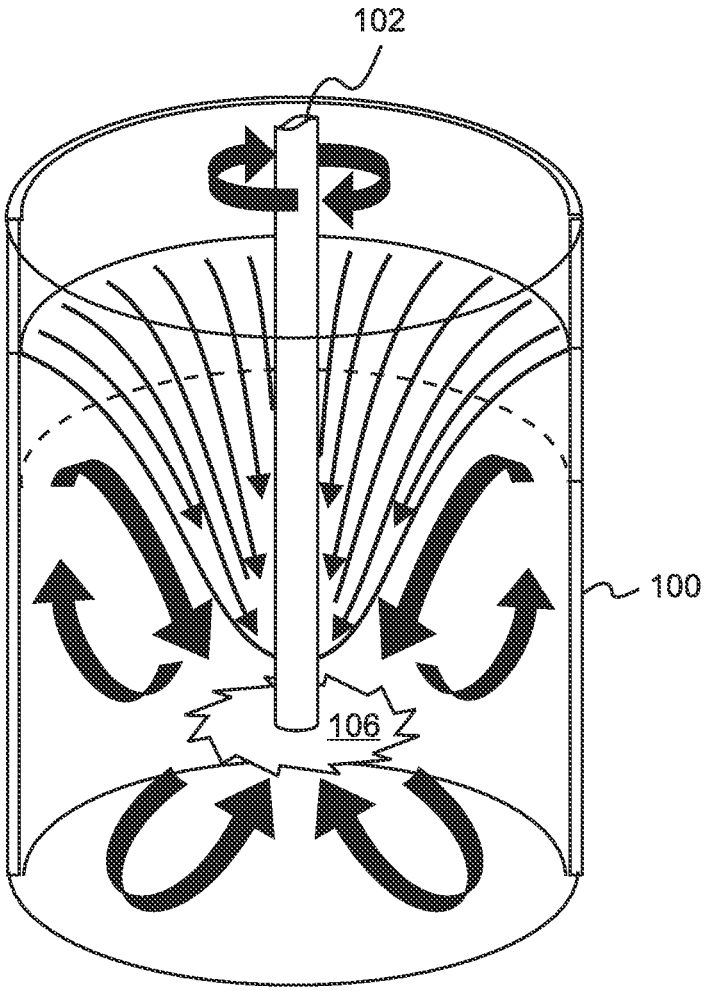
Figure 1C Prior Art
FIG. 1C illustrates the flow path of a mixture in a typical vertical shaft batch mixer of the prior art.
Figure 2:
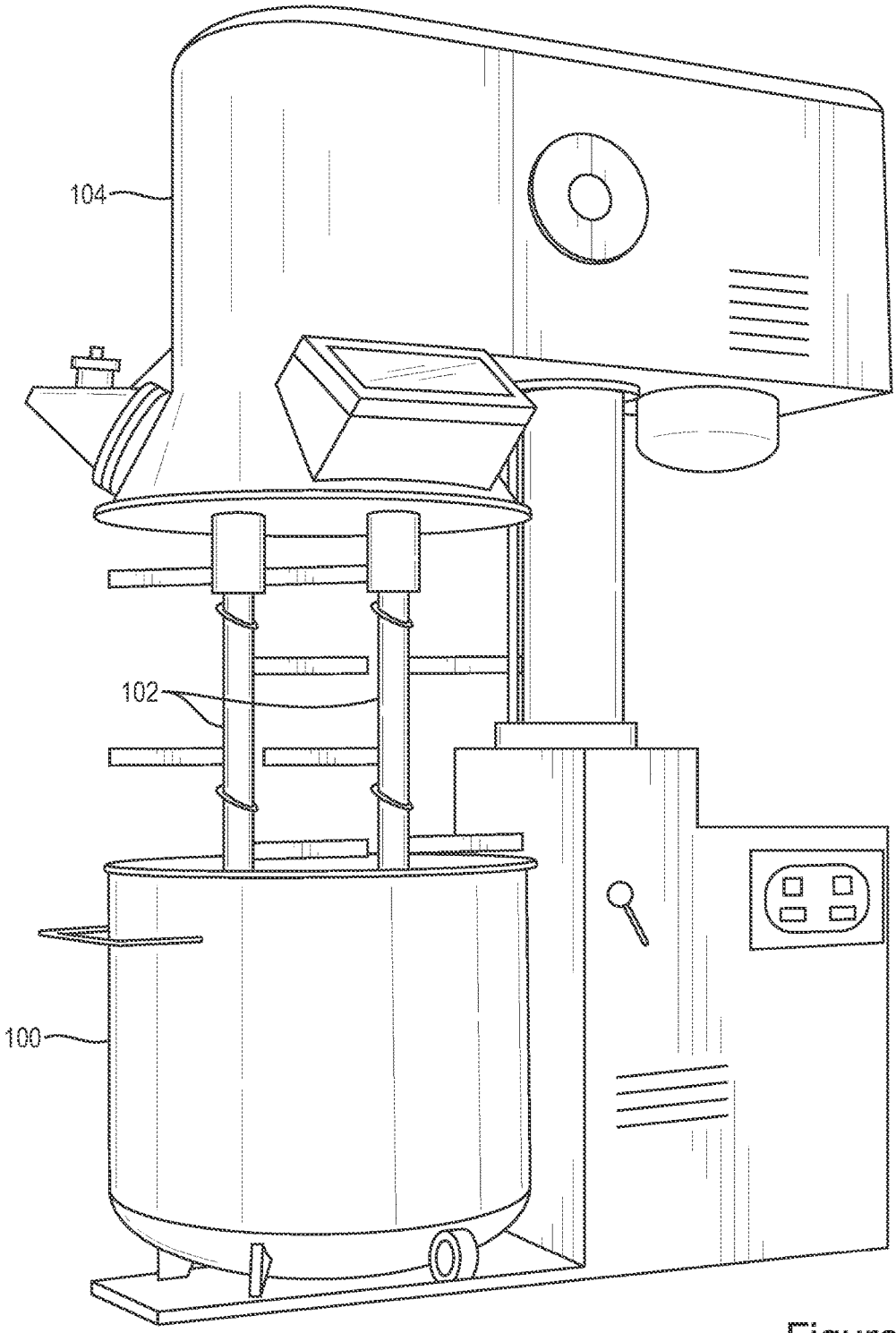
Figure 2 Prior Art
FIG. 2 is a perspective view of a multi-shaft vertical shaft batch mixer of the prior art.
Figure 3:
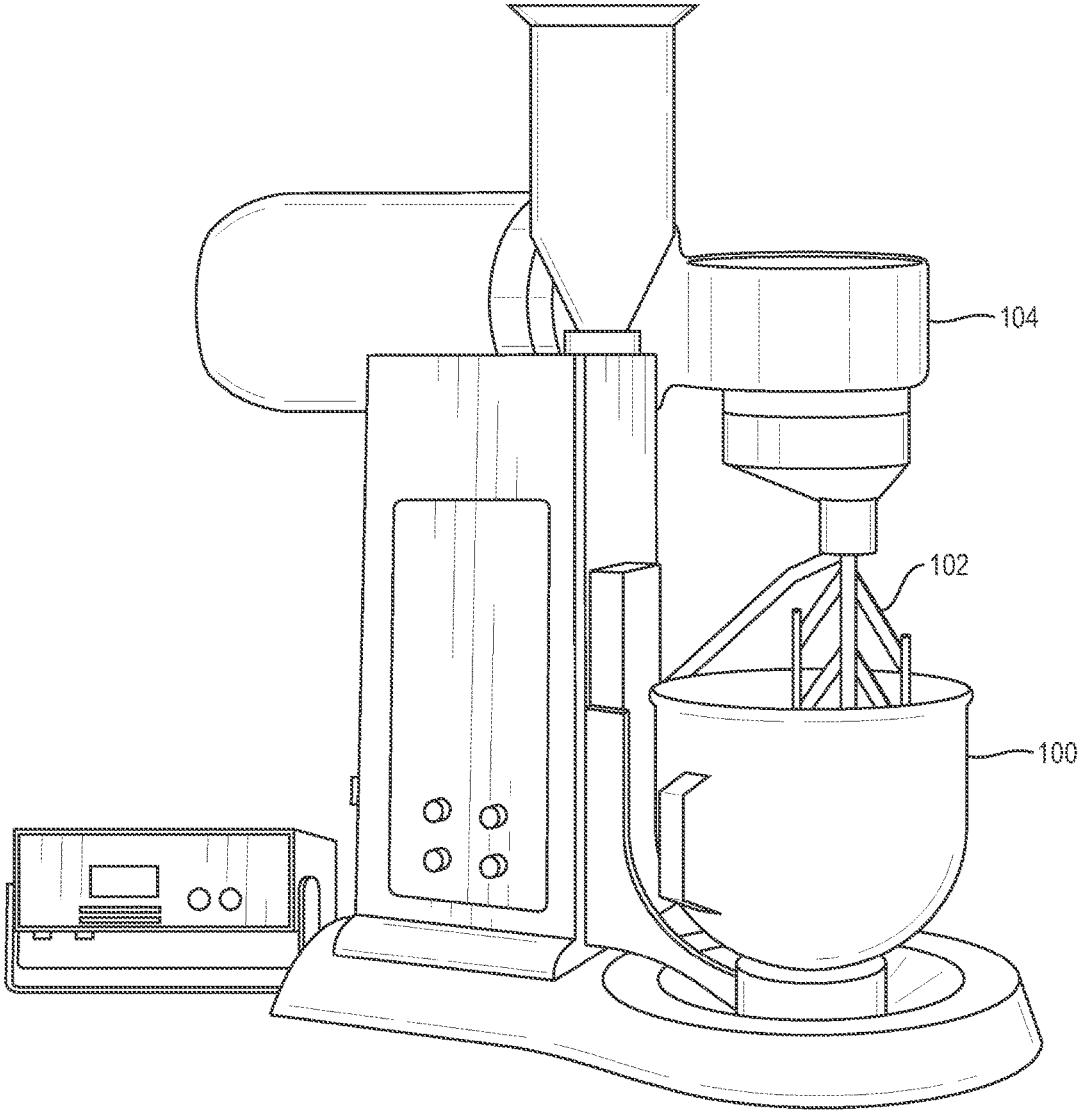
Figure 3 Prior Art
FIG. 3 is a perspective view of a vertical shaft batch mixer of the prior art having a planetary impeller.
Figure 4:
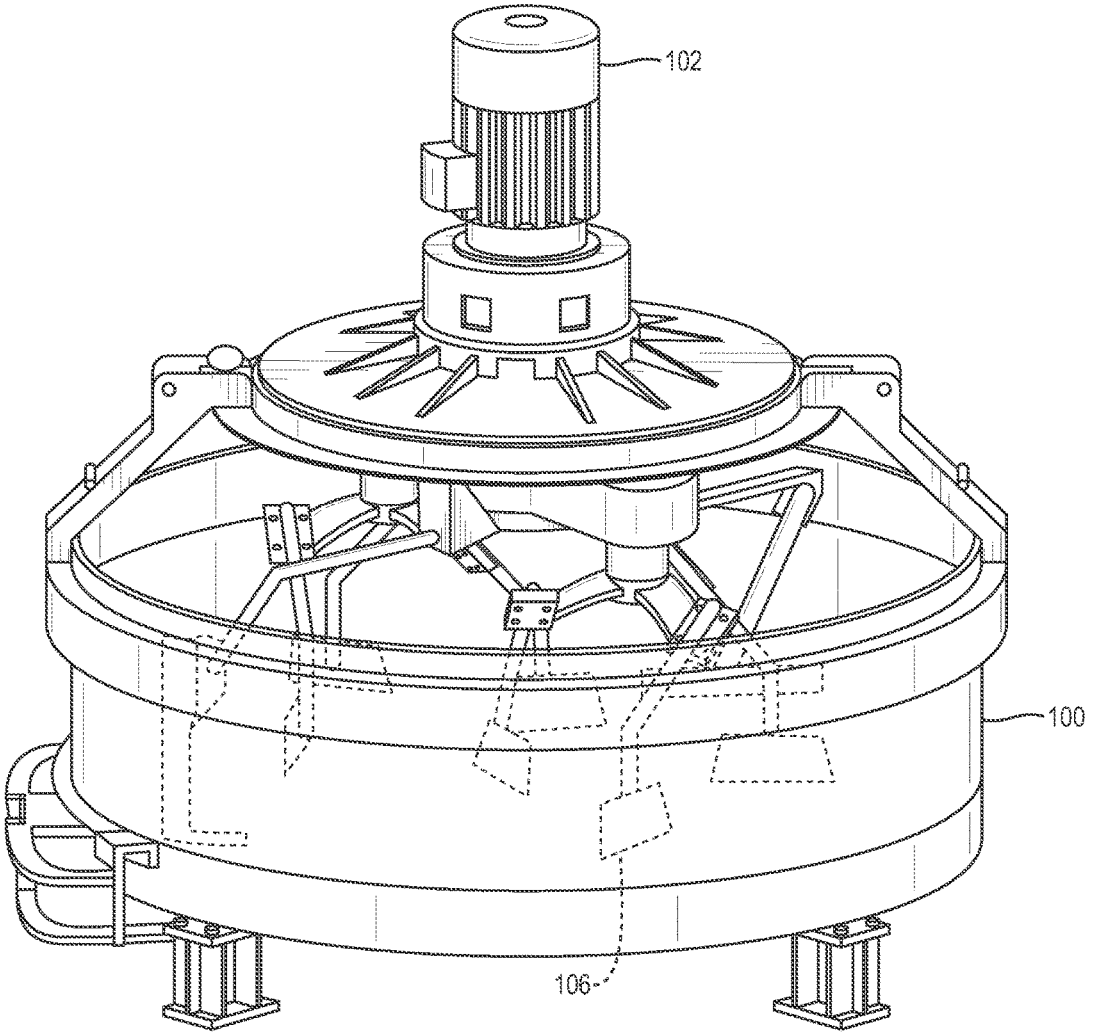
Figure 4 Prior Art
FIG. 4 illustrates the structure of a typical planetary impeller in a vertical shaft batch mixer of the prior art.
Figure 5:
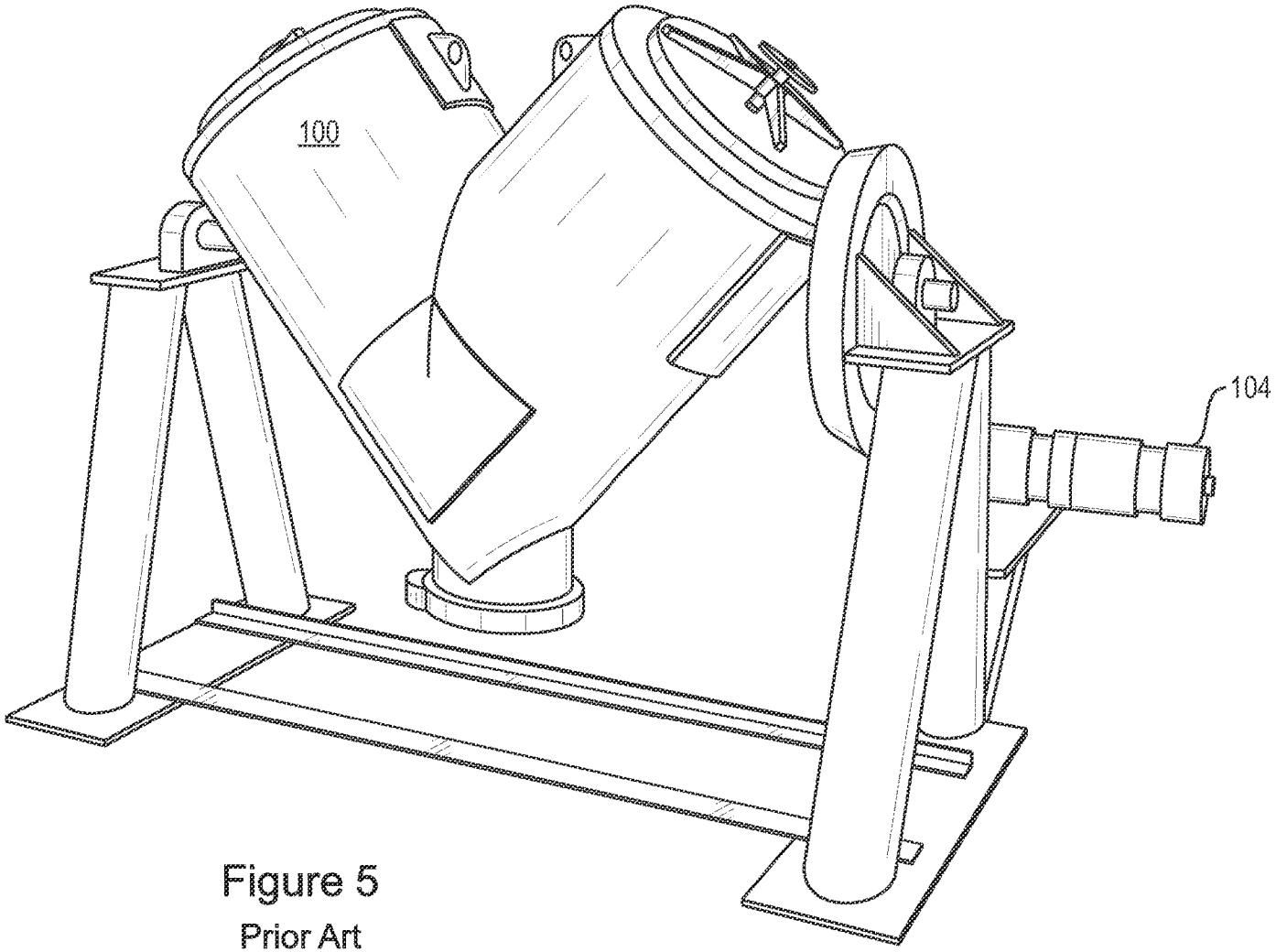
Figure 5 Prior Art
FIG. 5 is a perspective view of a V-shaped horizontal batch mixer of the prior art.
Figure 6:
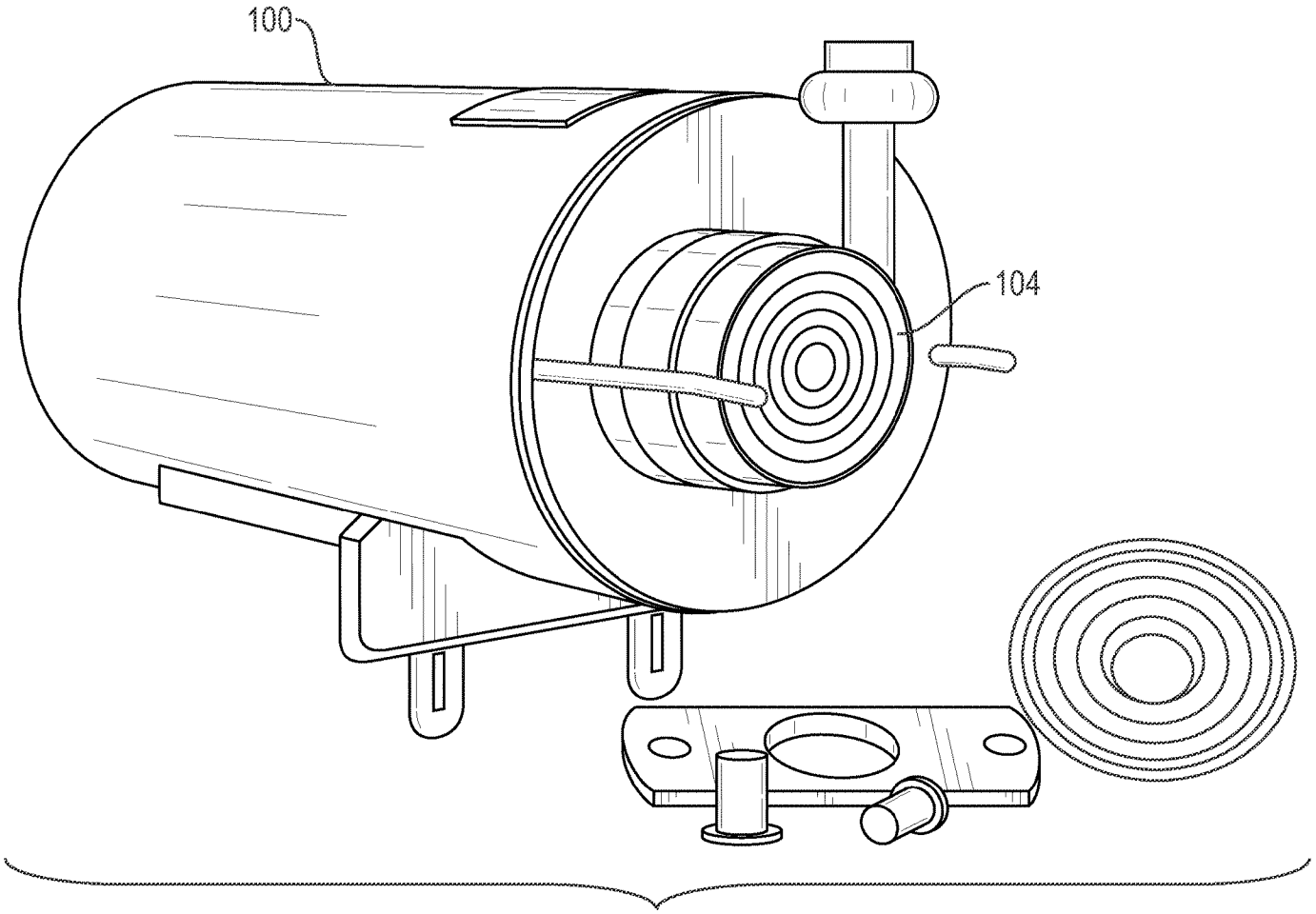
Figure 6 Prior Art
FIG. 6 is a perspective view of an enclosed horizontal batch mixer of the prior art.
Figure 7:
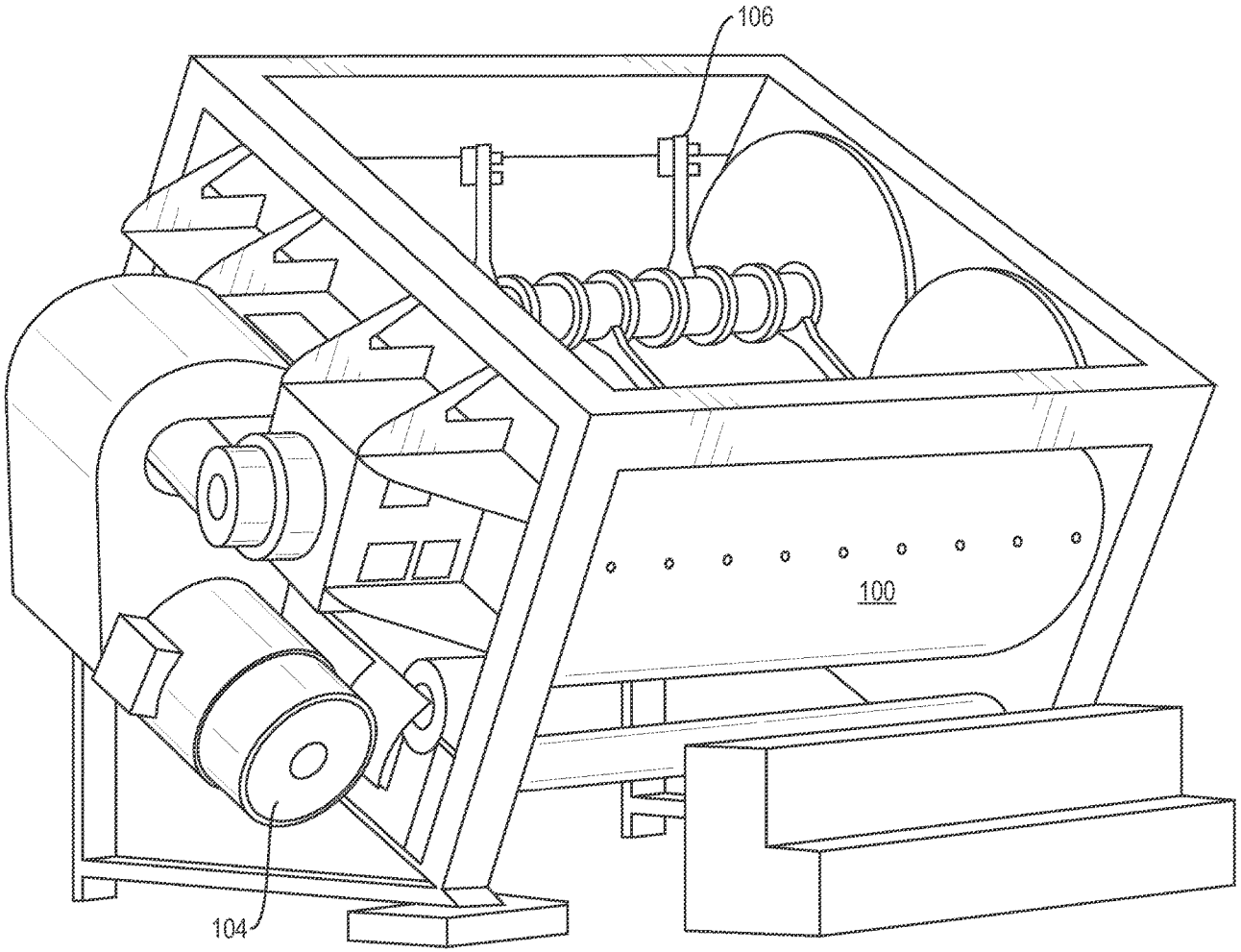
Figure 7 Prior Art
FIG. 7 is a perspective view of an open horizontal batch mixer of the prior art.
Figure 10:
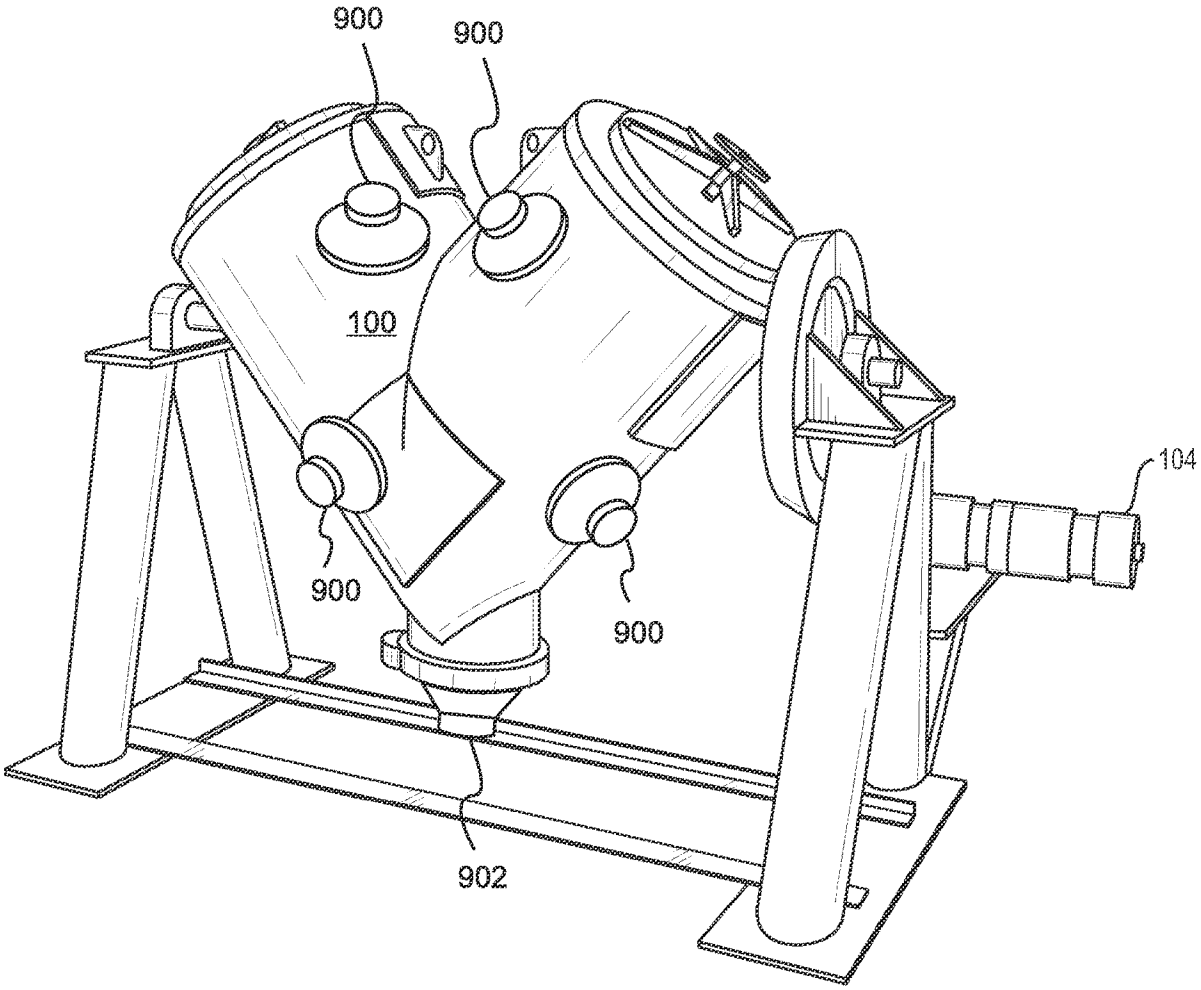
FIG. 10 is a perspective view similar to FIG. 5 showing an embodiment of the present invention applied to walls of the mixing container.

FIG. 10 illustrates an embodiment similar to FIG. 8, but applied to a "V" style horizontal axis mixer, with or without baffles or other mixing structures or devices as is illustrated in FIG. 5. In some embodiments which include either fixed position paddles and/or rotating blades on the inside of the container 100 to increase the mixing action of the rotating container 100, the mounting or attachment of the paddles or blades is flexible, allowing a small amount of movement of the paddles or blades such that vibration energy can be applied directly to the paddles or blades and transmitted by the paddles or blades into the mixture. This has the result of vastly increasing the mixing action on droplets and powder particles at and near the paddles or blades as the mixture tumbles past them during container rotations. The vibration of the paddles or blades causes rapid breakup of droplets and/or de-agglomeration of powder particle clumps, and promotes rapid mixing of immiscible liquids and various sized powder particles.

Figure 11:
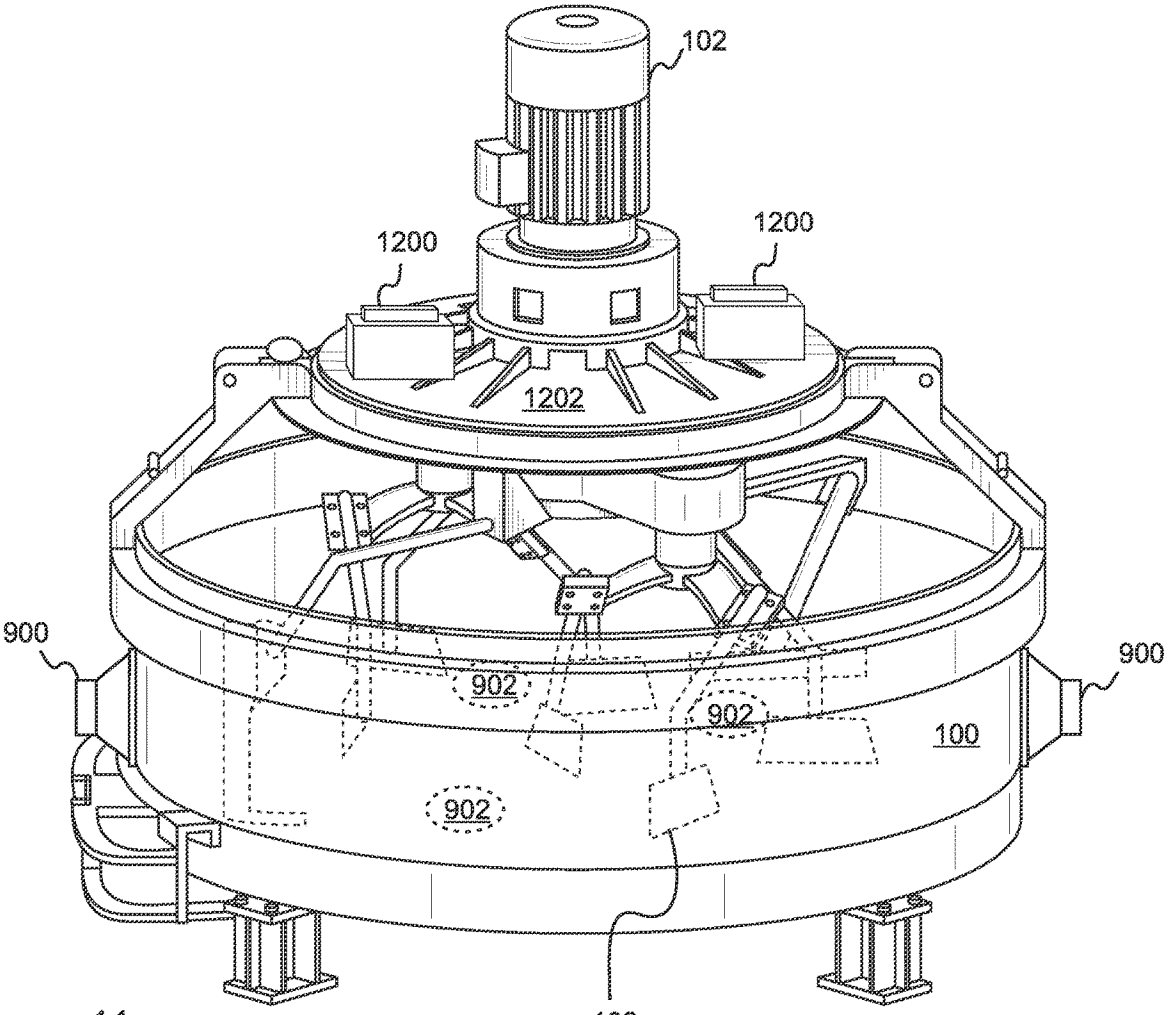
FIG. 11 is a perspective view similar to FIG. 4 showing an embodiment of the present invention applied to the wall, base, and planetary impeller of the mixing container.

FIG. 11 illustrates application of an embodiment to a vertical shaft batch mixer which includes a planetary impeller 106. Some vibrational energy applicators 900 are cooperative with the walls of the mixing container 100 and other vibrational energy applicators 902 are cooperative with the bottom of the mixing container 100. In addition, some vibrational energy applicators 1200 are cooperative with the mounting structure 1202 which supports the planetary impeller 106. The result is that the vibrational energy is transferred to the mixing blades of the planetary impeller 106, and imparted by the blades to the material being mixed at the interaction region (e.g. sheer area) between the mixed material and the impeller blades. This approach to applying vibrational energy throughout the interior of the mixing container 100 can be very effective for shortening the mixing time and total mixing energy requirement, especially when blending fine grains or powders together with a liquid.

Figure 12A:
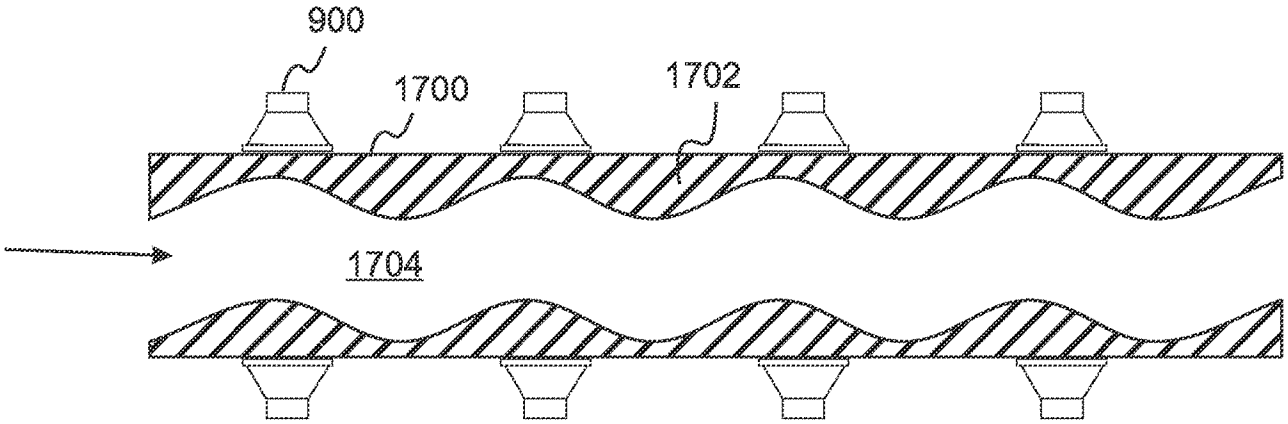
FIG. 12A is a cross-sectional side view of a continuous mixer mixing tube which has a wall thickness profile and which includes an embodiment of the present invention which propagates vibrational energy through the mixing tube wall.
Figure 12B:
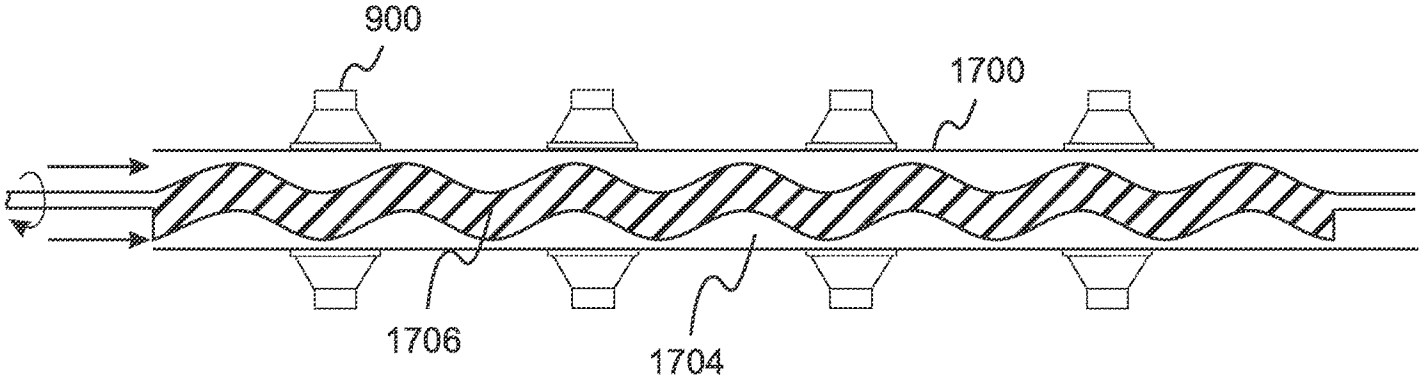
FIG. 12B is a cross-sectional side view of a continuous mixer mixing tube which includes a rotatable mixing shaft, and which includes an embodiment of the present invention which propagates vibrational energy through the mixing tube wall.

In FIG. 12A, vibrational energy is applied to a mixture through the outer wall of a mixing tube 1700 which has a profiled wall thickness 1702 forming a passage 1704 with a profiled shape. In the embodiment of FIG. 12B, a rotating mixer shaft 1706 is installed in the mixing tube 1700 of a continuous mixer. The mixer shaft 1706 has a non-round profile which moves the mixture within the passage 1704 and forms momentary areas of rapid and slow flow, and rapid and slow mixing. In various embodiments, the mixing chamber 1704 is smooth and straight-walled, as shown in FIG. 12B. In other embodiments a rotating mixer shaft 1706 is combined with a profiled mixing tube 1702, so as to increase the intensity of the mixing.

Without the vibrational energy of the present invention, the mixer designs illustrated in FIGS. 12A and 12B would be mainly unsuccessful in breaking up droplets in immiscible liquids and in mixing a powder with a liquid. The present invention, by applying vibrations (acoustic, ultrasonic, or both together) to the mixing tube 1700, causes the liquid droplets and/or the liquid/particle blend to vibrate, and vastly improves the overall mixing action of the device, especially with respect to using a lower quantity of the liquid phase and with respect to breaking up droplets and mixing and dispersing fine grains and powders. By tuning the vibration energy to the droplet or particle sizes of the mixture, the overall mixing forces can be optimized. Also, as previously described, heat (and pressure if needed to prevent "boiling" of the liquid) can be applied to the transiting mixture so as to reduce the viscosity and improve the dispersion of the powder granules and the breaking up of clumps and/or droplets by the applied vibrational energy.

Tuning the Vibrational Energy

As mentioned above, in various embodiments the frequencies and amplitudes of the applied acoustic and/or ultrasonic vibrational energy are adjusted or "tuned" according to properties of the substances being mixed, so as to optimize the mixing effectiveness of the vibrations. Following are three examples of materials to be processed and some factors and guidelines to consider when optimizing the speed, time, energy consumption, and quality (completeness for the intended purpose) of the mixing process.

Example 1

In this example a liquid, such as an adhesive or resin, or a liquid used in a paint or a food product, is combined with powder particles of a mineral or another material that must be evenly distributed into the liquid. The relative amount of the liquid can range from a large excess down to the minimum quantity needed to bind the particles together. It is generally more difficult to achieve complete mixing and dispersing of the particles for this situation of minimum liquid or binder. For the purposes of this example, the particle size distribution of the added solid material is assumed to be in the approximate range of 50-1000 microns, but can also be larger than 1000 microns or smaller than 50 microns.

In this example, the application of acoustic vibrational energy will cause the individual particles to move back and forth over a range from about 5% up to more than 100% of their diameters. By adjusting both the amplitude and the frequency of the vibrational energy, combinations of amplitude and frequency can be found for which the total mixture of liquid and solid particles will take on a more fluid-like behavior, and complete mixing will be achieved in less time and will be more complete.

A two-dimensional table or graph can be constructed showing the range of successful frequency and amplitude combinations as a subset of the entire range of possible frequency and amplitude combinations for that particular mixture. Note that for liquids of higher viscosity, a higher vibrational energy will generally be required, which can be achieved by applying a higher frequency, a higher amplitude, or both.

One simple method for obtaining an initial estimate of the range of successful frequency and amplitude combinations is to place only the solid particles into a container and then apply vibrational energy and observe a minimum frequency and amplitude combination at which the particles become more or less fluidized in the container, so that a much lower amount of energy is required to stir or mix the particles. This minimum frequency and amplitude will depend on the particle size distribution and particle density. This dry test data can be very useful as a starting point for the actual mixing process wherein the liquid is also included.

Example 2

In this example, a mixture of a liquid adhesive or resin, or another liquid material is combined with a range of particles of a mineral or other material that must be evenly distributed and dispersed into the liquid. The relative amount of the liquid can range from a large excess down to the minimum quantity needed to bind the particles together. It is generally more difficult to achieve complete mixing and dispersing of the particles for this situation of minimum liquid or binder. For the purposes of this example, the particle size distribution of the added solid material is assumed to be in the approximate range of 0 to 100 microns, which are essentially powdered materials. For this range of particle sizes it will be very useful to apply ultrasonic vibration, ranging from low frequencies up to 15,000 Hz for large powder particles to much higher frequencies of 10,000 Hz to several MHz for very small particles, to cause the individual particles to move back and forth over a range from approximately 5% up to 100% and more of their diameter. This will vastly increase the rate of mixing or dispersion into the liquid phase and will improve the de-agglomeration of particle groups and clumps.

As with Example 1 above, a two-dimensional table or graph can be constructed showing the range of successful frequency and amplitude combinations as a subset of the entire range of possible frequency and amplitude combinations for this particular mixture, and can be further adjusted depending upon the liquid viscosity and the degree of "filler loading" of powder into the liquid. The dry test method described above can be used to yield useful data for the starting point for when the process is applied to the complete mixture of liquid and solid.

Example 3

In this example, there is included a first quantity of a solid having the rather large particle size distribution of Example 1 and also a second quantity of a solid having the particle size distribution of Example 2. Therefore it will be seen that the application of both acoustic and ultrasonic vibration energies at the same time will facilitate the mixing of the entire range of included particle sizes.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A mixing apparatus for mixing a first substance with a second substance, the mixing apparatus comprising:

a mixing container having an interior which is able to contain a mixable combination of the first substance and the second substance, the interior being surrounded by one or more walls of said container;

a convection mechanism for applying convective mixing forces to the mixable combination;

a vibration application system comprising an exterior vibrational energy applicator that is able to propagate acoustic vibrations through a wall section of a corresponding one of the container walls without directly exposing the exterior vibrational energy applicator to the container interior, the vibration application system being configured to apply vibrational energy to the mixable combination while the convective mixing forces are applied to the mixable combination; and an ultrasonic generator which is able to apply ultrasonic energy to the mixable combination while the convective mixing force and acoustic vibrations are simultaneously applied to the mixable combination.

2. The mixing apparatus of claim 1, wherein the mixing apparatus is a batch mixer.

3. The mixing apparatus of claim 2, wherein the mixing apparatus is a vertical shaft batch mixer.

4. The mixing apparatus of claim 2, wherein the mixing apparatus is a horizontal batch mixer.

5. The mixing apparatus of claim 1, wherein the mixing apparatus is a continuous mixer.

6. The mixing apparatus of claim 5, wherein the continuous mixer includes a mixing tube having a wall with a non-uniform thickness profile.

7. The mixing apparatus of claim 5, further comprising a rotatable mixing shaft contained within a mixing tube of the continuous mixer.

8. The mixing apparatus of claim 7, further comprising a plurality of mixing shafts contained within the mixing tube of the continuous mixer.

9. The mixing apparatus of claim 1, wherein the wall section of the mixing container through which the exterior vibrational energy applicator is able to propagate acoustic vibrations is thinner than surrounding portions of the container walls.

10. The mixing apparatus of claim 1, wherein the wall section of the mixing container through which the exterior vibrational energy applicator is able to propagate acoustic vibrations is coupled to a remainder of the container walls by an elastomeric material.

11. The mixing apparatus of claim 1, wherein the vibration application system further includes an interior vibration applicator that is able to apply vibrational energy to a mixing feature which extends into the interior of the mixing container.

12. The mixing apparatus of claim 11, wherein the mixing feature is a mixing impeller.

13. The mixing apparatus of claim 11, wherein the mixing feature is a fin or baffle attached to one of the walls of the mixing container.

14. The mixing apparatus of claim 13, wherein the fin or baffle is attached to the wall by a flexible attachment which allows movement of the fin or baffle relative to the wall.

15. The mixing apparatus of claim 1, wherein the vibration application system includes a plurality of exterior vibrational energy applicators configured to propagate vibrations through corresponding sections of the one or more walls of the container without directly exposing any of the plurality of exterior vibrational energy applicators to the container interior, the vibration application system being configured to apply the vibrational energy at a substantially uniform intensity throughout the mixable combination.

16. The mixing apparatus of claim 1, wherein the vibration application system includes a plurality of exterior vibrational energy applicators configured to propagate vibrations through corresponding sections of the one or more walls of the container without directly exposing any of the plurality of exterior vibrational energy applicators to the container interior, the vibration application system being configured to concentrate the vibrational energy in a desired sub-region of the interior of the mixing container.

17. The mixing apparatus of claim 1, further comprising a heating apparatus which is able to heat the mixable combination while the convective mixing forces and vibrational energy are applied to the mixable combination.

18. The mixing apparatus of claim 1, wherein the mixing container is configured so that it can be pressurized while the convective mixing force and the vibrational energy are applied to the mixable combination.

* * * * *